US005511612A

United States Patent [19]

Tajima et al.

[11] Patent Number: 5,511,612

[45] Date of Patent: Apr. 30, 1996

[54] OIL COOLER HAVING WATER PIPE REINFORCEMENT

[75] Inventors: Makoto Tajima, Tokyo; Kei Beppu, Kanagawa; Tomoyuki Mano, Tokyo; Shigeru Sasaki, Kanagawa, all of Japan

[73] Assignee: Calsonic Corporation, Tokyo, Japan

[21] Appl. No.: 125,656

[22] Filed: Sep. 23, 1993

[30] Foreign Application Priority Data

Sep. 24, 1992 [JP] Japan ..... 4-66563 U

[51] Int. Cl.[6] ..... F28F 3/08; F01M 11/03; F01M 5/00; F28D 9/00

[52] U.S. Cl. ..... 165/167; 165/916; 165/906; 165/51

[58] Field of Search ..... 165/916, 167, 165/906, 41, 51

[56] References Cited

U.S. PATENT DOCUMENTS

| | | | |
|---|---|---|---|
| 2,511,084 | 6/1950 | Shaw | 165/916 |
| 4,058,980 | 11/1977 | Ahlen | 165/916 |
| 4,768,580 | 9/1988 | Ferguson | 165/916 |
| 5,014,775 | 5/1991 | Watanabe | 165/916 |
| 5,099,912 | 3/1992 | Tajima et al. | 165/133 |
| 5,146,980 | 9/1992 | Le Gauyer | 165/916 |
| 5,165,468 | 11/1992 | Tojima et al. | 165/916 |
| 5,180,005 | 1/1993 | Marsovi et al. | 165/916 |
| 5,180,006 | 1/1993 | Marsovi et al. | 165/916 |

FOREIGN PATENT DOCUMENTS

| | | | |
|---|---|---|---|
| 3824073 | 2/1990 | France | 165/916 |
| 1579276 | 11/1980 | United Kingdom . | |

*Primary Examiner*—John K. Ford

*Attorney, Agent, or Firm*—Sughrue, Mion, Zinn, Macpeak & Seas

[57] ABSTRACT

The device relates to an oil cooler and the object thereof is to provide an oil cooler with an improved mounting strength of water pipes against external stresses. A core portion 33 is formed by alternately stacking a plurality of plates 35, 37 and arranging cooling water passages 39 and oil passages 41 alternately between these plates 35, 37. On an upper portion of the core portion 33 is an oil tank 57 that is formed of an upper plate 47 and a cover plate 55. The upper plate 47 has a cooling water passage holes 43 communicating with the cooling water passages 39 and the oil passages 41. The cover plate 55 has water pipe insertion holes 51, 53 so as to correspond to the cooling water passage holes 43. The water pies 59, 61 are inserted into the cooling water passage holes 43 of the upper plate 47 by causing the water pipes 59, 61 to pass through the water pipe insertion holes 51, 53.

5 Claims, 7 Drawing Sheets

OIL COOLER HAVING WATER PIPE REINFORCEMENT

BACKGROUND OF THE INVENTION

The device relates to an oil cooler formed by stacking a plurality of plates.

As a conventional oil cooler formed by stacking a plurality of plates, one that is disclosed, e.g., in Japanese Utility Model Unexamined Publication No. 121270/1988 is known. FIGS. 8 to 10 show the oil collar disclosed in the above-mentioned publication. In FIGS. 8 to 10, reference numeral 1 designates a core portion having cooling water passages 7 and oil passages 9 between plates 3, 5 that are formed by alternately stacking the plurality of plates 3, 5. An upper plate 19 is firmly fixed on the upper end surface of the core portion 1. The upper plate 19 has an opening 11 in the middle and three openings 13, 15, 17 around the opening 11.

The two diametrically opposed openings 13, 15 communicate with the cooling water passages 7, and the opening 17 communicates with the oil passages 9. Water pipes 21, 23 are coupled to both openings 13, 15. A reinforcing partition plate 27 formed of an expanding portion 25 that covers both the opening 17 communicating with the oil passages 9 and the opening 11 arranged in the middle of the upper plate 19 is mounted on the upper plate 19.

In FIG. 9, reference numeral 29 designates a lower plate secured to the lower end surface of the core portion 1. In the middle of the lower plate 29 is an opening 31 formed so as to correspond to the opening 11. Further, an opening (not shown) communicating with the oil passages 9 is arranged so as to correspond to the opening 17.

According to the thus constructed oil cooler, cooling water introduced from a hose (not shown) connected to one 21 of the water pipes is discharged to a hose (not shown) connected to the other water pipe 23 via the cooling water passages 7 of the core portion 1. Oil introduced into the core portion 1 from the opening of the lower plate 29 is heat-exchanged with the cooling water while flowing through the oil passages 9 and reaches the expanding portion 25 from the opening 17.

However, as shown in FIG. 10, the water pipes 21, 23 of the oil cooler 1 are of a so-called cantilever-type support structure with insertion-side ends 21*a*, 23*a* thereof being simply inserted into the openings 13, 15 of the upper plate 19, respectively. Therefore, a shortcoming that the mounting strength of the water pipes 21, 23 is not sufficient against external stresses (e.g., a force applied when the water pipes are being inserted into the hoses, vibrations of the hoses, etc.).

SUMMARY OF THE INVENTION

The device has been made in view of the above circumstances. Accordingly, the object of the device is to provide an oil cooler featuring an improved mounting strength of the water pipes against external stresses.

To achieve the above object, the device relates to an oil cooler having a core portion formed by alternately stacking a plurality of plates and alternately forming cooling water passages and oil passages between the plates. In such an oil cooler, an oil tank is formed on an upper portion of the core portion. The oil tank is formed of an upper plate and a cover plate. The upper plate has cooling water passage holes and an oil passage hole. The cover plate has water pipe insertion holes so as to correspond to the cooling water passage holes.

The cooling water passage holes and the oil passage hole communicate with the cooling water passages and the oil passages. Two water pipes are made to pass through the respective pipe insertion holes of the cover plate and through the oil tank to thereby insert the two water pipes into the respective cooling water passage holes of the upper plate.

According to the device, the cooling water introduced from one of the water pipes is discharged from the other water pipe after filling the cooling water passages within the core portion. The water pipes are supported by the so-called two-point support structure by the water pipe insertion holes of the cover plate and the cooling water passage holes of the upper plate, which pass through the oil tank, so that the water pipes are mounted rigidly against external stresses.

DETAILED DESCRIPTION OF THE PREFERRED EMBODIMENTS

Embodiments of the device will now be described in detail with reference to the drawings.

Figure 1:
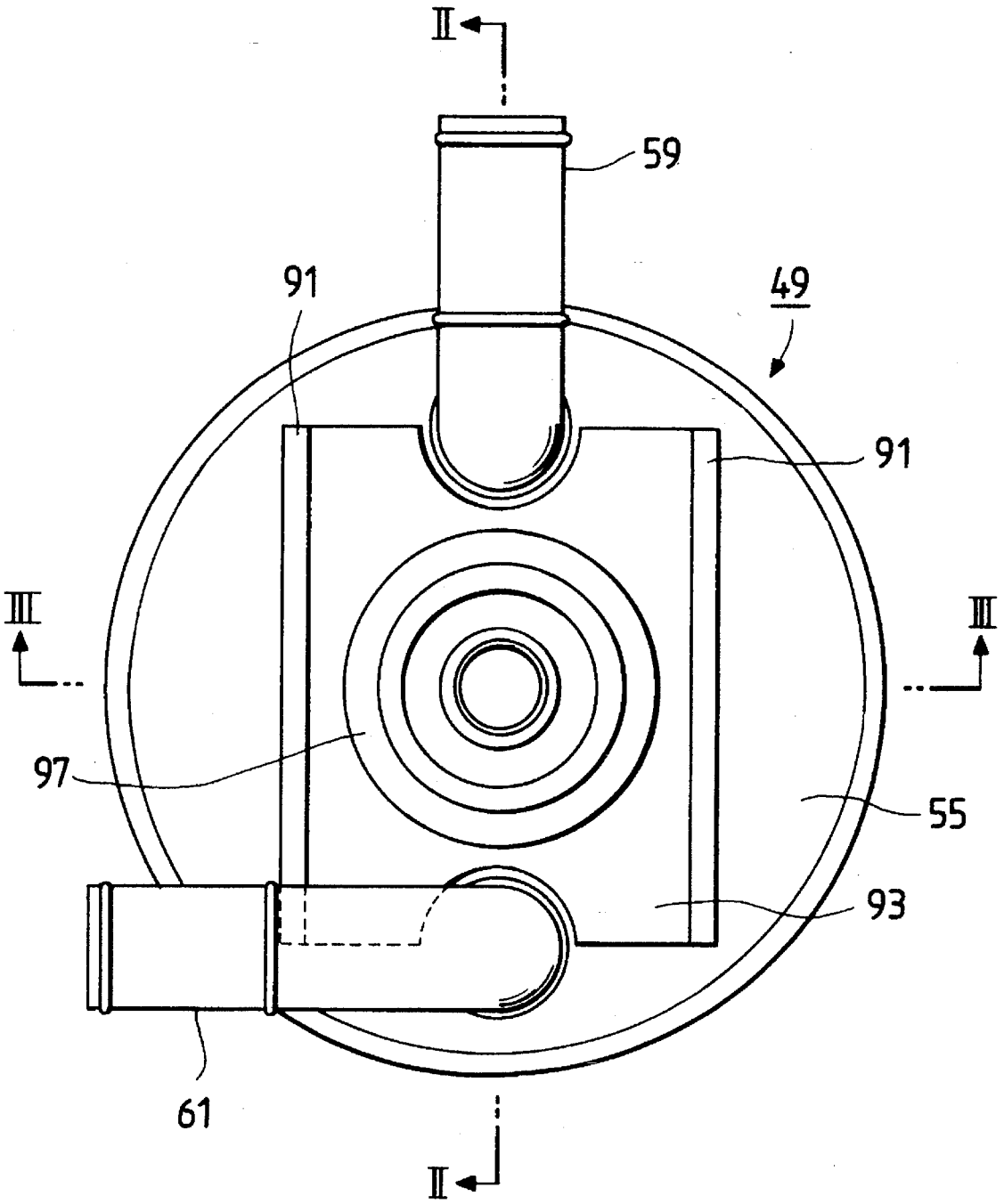
FIG. 1 is a plan view of an oil cooler, which is a first embodiment of the device.
Figure 2:
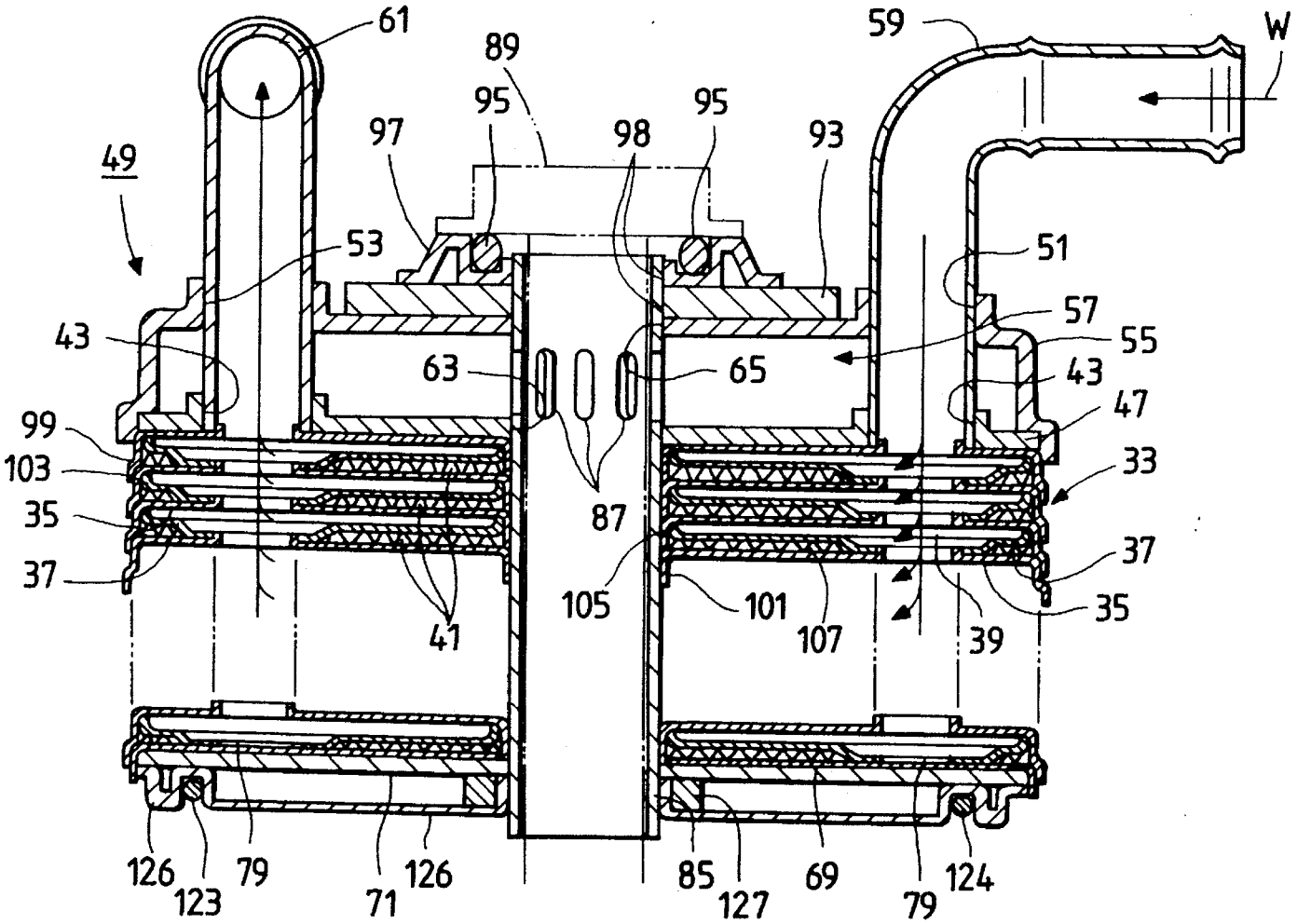
FIG. 2 is a sectional view taken along a line II—II of FIG. 1.
Figure 3:
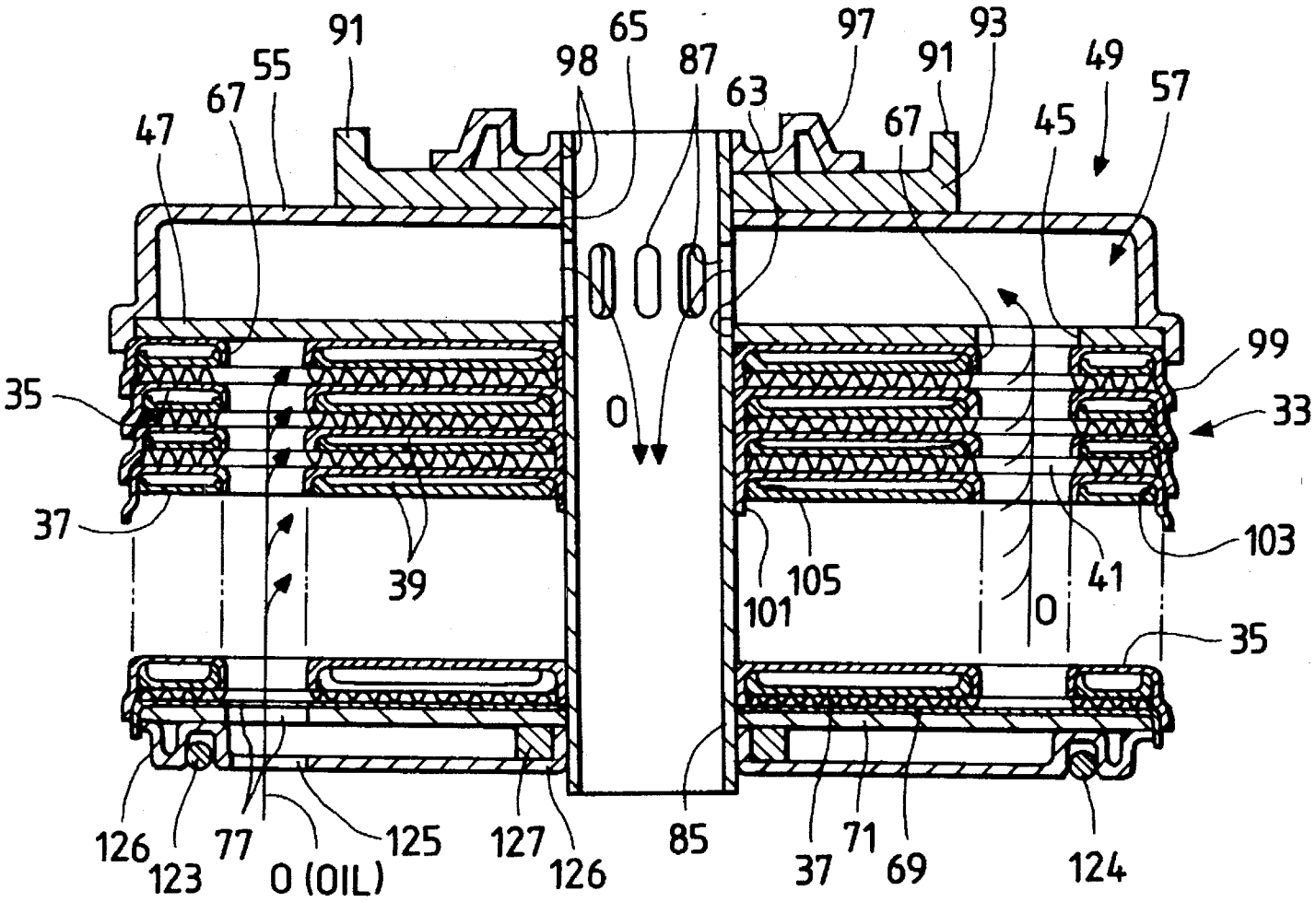
FIG. 3 is a sectional view taken along a line III—III of FIG. 1.

FIG. 1 is a plan view of an oil cooler, which is a first embodiment of the device; FIG. 2 is a sectional view taken along a line II—II of FIG. 1; and FIG. 3 is a sectional view taken along a line III—III of FIG. 1. In FIGS. 1 to 3, reference numeral 33 designates a core portion, which is formed by stacking a first plate 35 and a second plate 37 alternately and extending cooling water passages 39 and oil passages 41 alternately between these plates 35, 37 (see U.S. Pat. No. 5,099,912 for details). The first plate and the second plate are made of aluminum. On the upper end surface of the core portion 33 is an upper plate 47 firmly fixed. The upper plate, which is made of aluminum, has two cooling water passage holes 43 and an oil passage hole 45 respectively communicating with the cooling water passages 39 and the oil passages 41. An oil cooler 49, which is the first embodiment of the device, has an oil tank 57 that is formed on top of the core portion 33. The oil tank 57 is formed of the upper plate 47 and a cover plate 55 made of aluminum and having water pipe insertion holes 51, 53 so as to correspond to the cooling water passage holes 39.

Two water pipes 59, 61 for introducing cooling water into the core portion 33 are inserted into the cooling water passage holes 43 of the upper plate 47 while passing through the respective water pipe insertion holes 51, 53 of the cover plate 55 and through the oil tank 57.

Figure 4:
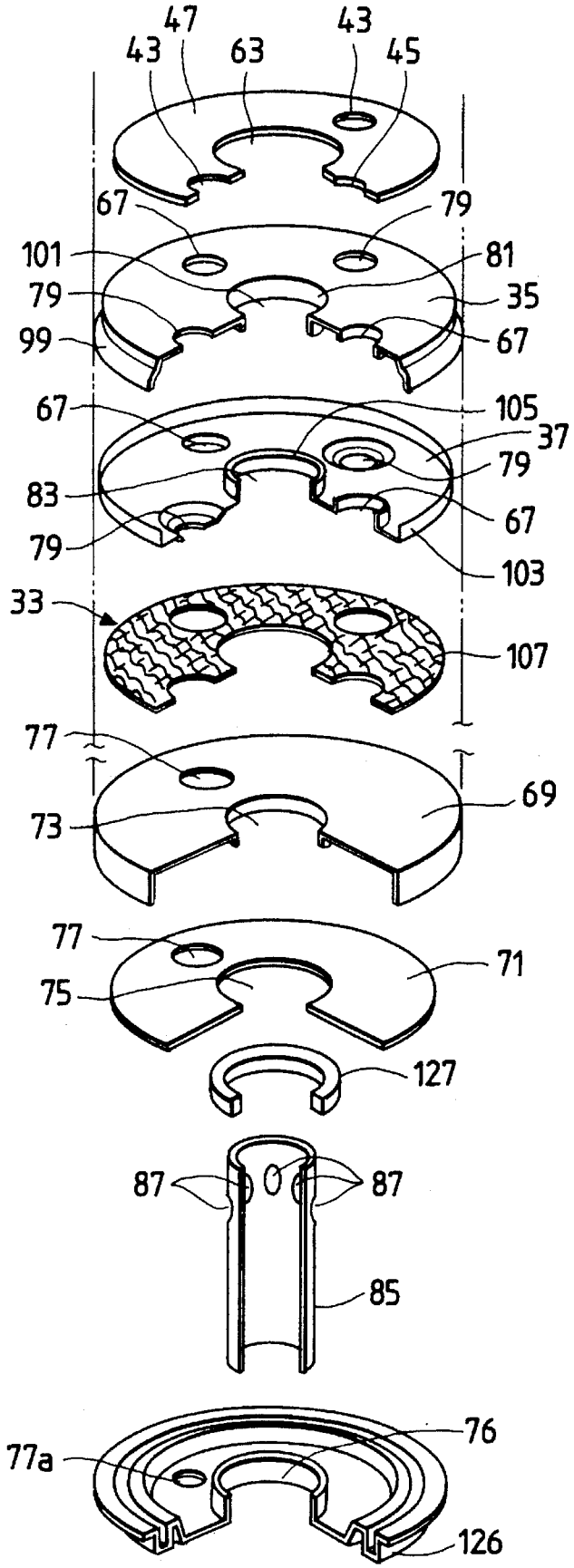
FIG. 4 is an exploded perspective view of a core portion.

Further, as shown in FIGS. 2 and 3, in the middle of the upper plate 47 and the cover plate 55 are through-hole 63, 65, whereas, as shown in FIG. 4, the oil passage holes 45 communicating with one of two oil passage holes 67 provided on the first plate 35 are formed on the upper plate 47. The other oil passage hole 67 of the first plate 35 is closed by the upper plate 47.

On the other hand, as shown in FIG. 3 or 4, under the core portion 33 are a lower plate 69 made of aluminum, a reinforcing plate 71, a reinforcing ring 127 and a seal plate 126 that are arranged sequentially. In the middle of each of the plates 69, 71, 126 are the through-holes 73, 75, 76 that are arranged coaxially with the through-holes 63, 65.

On both sides of the through-holes 73, 75, 76 of these plates 69, 71, 126 is an oil flow hole 77 that is opened for one of the two oil passage holes 67 arranged on the second plate 37. The other oil passage hole 67 of the second plate 37 is closed by the lower plate 69, whereas the two cooling water passage holes 79 arranged on the second plate 37 are also closed by the lower plate 69. Further, as shown in FIGS. 2 and 3, on the lower portion of the reinforcing plate 71 is the seal plate 126, which has a recessed portion 124 and an oil inlet hole 77*a* for accommodating a lower portion O-ring 123.

Further, in the middle of the first plate 35 and the second plate 37 forming the core portion 33 are through-holes 81, 83. A collar 85 made of aluminum is inserted through the through-holes 81, 83 and the above-mentioned respective through-holes 63, 65, 73, 75, 76. As shown in FIG. 2, on the peripheral wall of the collar 85 positioned within the oil tank 57 are a plurality of oil passage holes 87 communicating with the oil tank 57. A hollow stud bolt 89 having a plurality of oil passage holes (not shown) communicating with the oil tank 57 is inserted into the collar 85 to fix the oil cooler 49 on a bracket (not shown) or the like of an engine. On top of the cover plate 55 is a reinforcing plate 93 having flanges 91 on both ends thereof to reinforce the cover plate 55. This reinforcing plate 93 is located between both water pipes 59, 61. Further, on top of the reinforcing plate 93 is a seat 97 having an O-ring 95 fitted thereto. In the middle of each of the reinforcing plate 93 and the seat 97 is a through-hole 98 allowing the collar 85 to pass therethrough. It is designed so that the reinforcing plate 93 prevents deformation of the cover plate 55 due to tightening the stud bolt 89 when the oil cooler 49 is fixed by inserting the stud bolt 89 into the collar 85 that projects from the through-hole 98.

By the way, as shown in FIG. 4, four through-holes are formed at an interval of 90° around the center on the first plate 35 and the second plate 37. The two diametrically confronting through-holes serve as the above-mentioned cooling water passage holes 79, whereas the other diametrically confronting through-holes serve as the above-mentioned oil passage holes 67.

Cylindrical portions 99, 101 are formed integrally on the outer periphery and the through-hole periphery of the first plate 35, and projecting portions 103, 105 projecting toward the first plate 35 are formed integrally on the outer periphery and the through-hole periphery of the second plate 37. As shown in FIGS. 2 and 3, the outer sides of the projecting portions 103, 105 of the second plate 37 are brazed to the inner sides of the cylindrical portions 99, 101 of the first plate 35. Each cooling water passage 39 is formed of the inner side of the first plate 35 and the inner side of the second plate 37 from the uppermost layer of the core portion 33, whereas each oil passage 41 is formed of the outer side of the second plate 37, the outer side of the first plate 35, and the inner sides of the cylindrical portions 99, 101 of the first plate 35 so as to alternate with the cooling water passage 39. An inner fin 107 extends within each oil passage 41.

Figure 5:
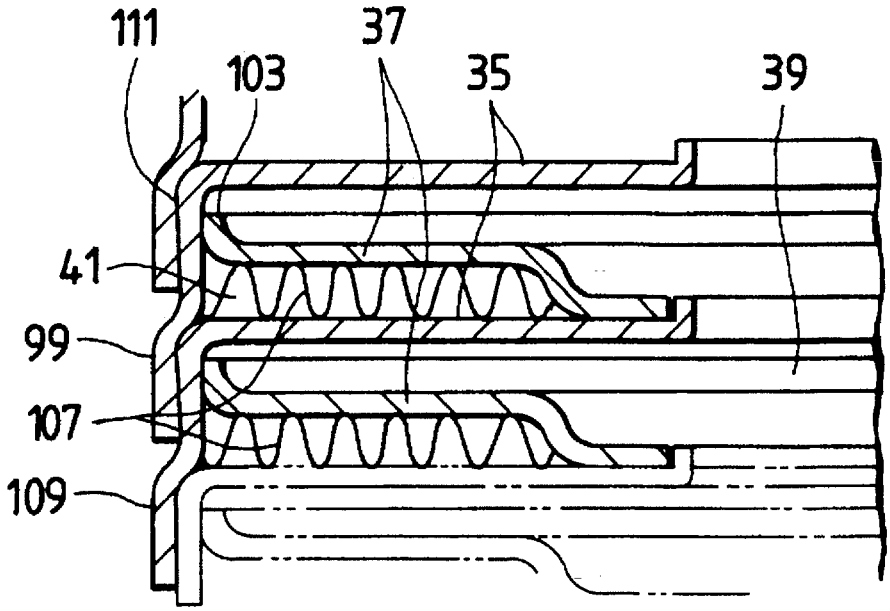
FIG. 5 is a partially enlarged sectional view of the core portion.
Figure 6:
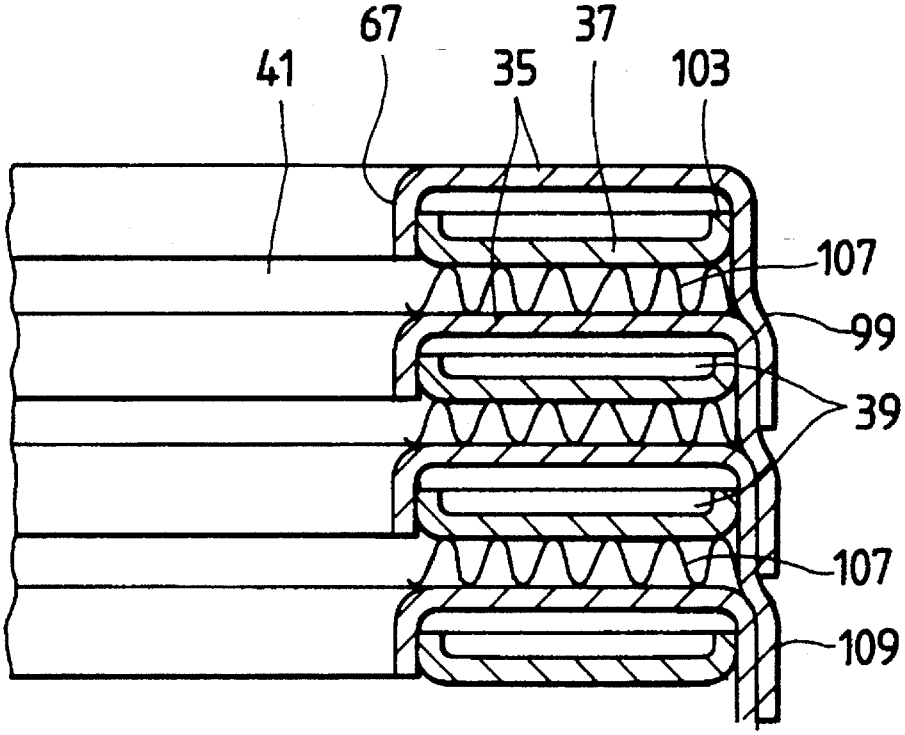
FIG. 6 is a partially enlarged sectional view of the core portion.

Further, as shown in FIGS. 5 and 6, a large-diameter portion 109 and a small-diameter portion 111 are formed on the cylindrical portion 99 of the first plate 35. The second plate 37 is arranged in the first plate 35 with the large-diameter portion 109 of the upper first plate 35 being brazed so as to be fitted into the neighboring small-diameter portion 111 of the lower first plate 35.

Thus, in this embodiment the cover plate 55 is formed by press-molding a clad member made of aluminum. The clad member is prepared by forming brazed layers (e.g., JIS4343, 4045) on both sides of a core material (e.g., JIS3003). The upper plate 47 is similarly formed so that both sides thereof are made of brazed layers, whereas the water pipes 59, 61 are formed so that the inner and outer peripheries thereof are covered with sacrificial corrosiond layers (e.g., JIS7072, 5005, etc.).

The above-mentioned oil cooler 49 of the device is fabricated as follows. Non-corrosive flux is applied to the respective parts and dried. Then, the projecting portions 103, 105 of the second plate 37 are fitted into the cylindrical portions 99, 101 of the first plate 35. Further, the large-diameter portion 109 of the first plate 35 is fitted into the small-diameter portion. Then, the collar 85 is inserted into the through-holes 81, 83 arranged in the middle of these plates 35, 37 to thereby form the core portion 33. The upper plate 47, the cover plate 55, the water pipes 59, 61, the lower plate 69, the reinforcing plate 71, the seal plate 126, and the like are assembled sequentially. The assembled portion is heated in a furnace to thereby braze the respective parts together.

The oil cooler 49 of the device is constructed as described above. Therefore, to fix the oil cooler 49 on a bracket of an engine or the like, the stud bolt 89 is inserted into the collar 85 and tightened while providing the O-ring 95 and the lower O-ring 123. Tightening stresses of the stud bolt 89 are scattered around by the reinforcing plate 93 arranged between the water pipes 59, 61. The reinforcing plate 93 also contributes to preventing the oil tank 57 from deforming by suppressing the deformation of the cover plate 55 due to differences between the atmospheric pressure and the pressure within the oil tank 57. This means that the reinforcing plate can be dispensed with if the cover plate is made sufficiently thick.

As shown in FIG. 2, water W introduced from the water pipe 59 fills the respective cooling water passages 39 via the cooling water passage holes 79 of the first plate 35 and the second plate 37, and is discharged from the other water pipe 61. Oil 0 flows into the core portion 33 via the lower oil flow hole 77 of the core portion 33 as shown in FIG. 3, fills the oil passages 41 via the respective oil passage holes 67 thereafter, flows into the oil tank 57 after being heat-exchanged with the cooling water W inside the cooling water passages 39, and is recirculated toward the engine through the stud bolt 89 from the oil passage holes 87. In this process, the water pipes 59, 61 are firmly supported against external stresses by a so-called two-point support structure formed of the water pipe insertion holes 51, 53 of the cover plate 55 and the cooling water passage holes 43 of the upper plate 47.

Figure 8:
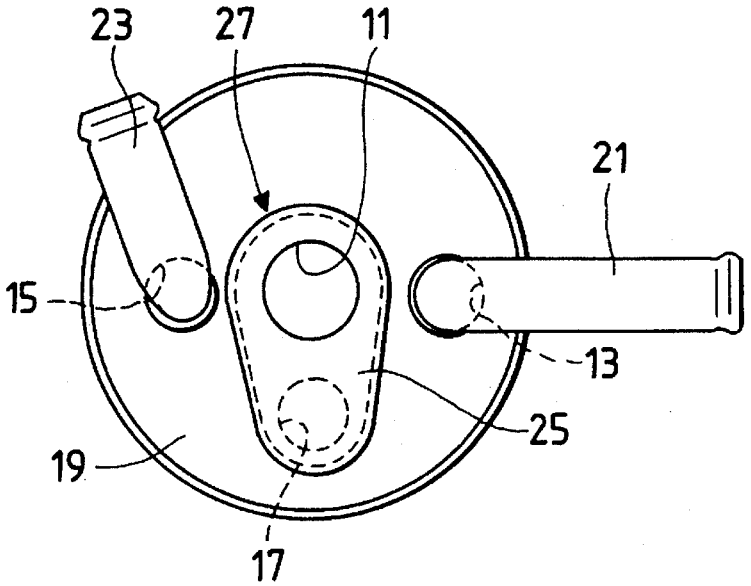
PRIOR ART FIG. 8
FIG. 8 is a plan view of a conventional oil cooler.
Figure 9:
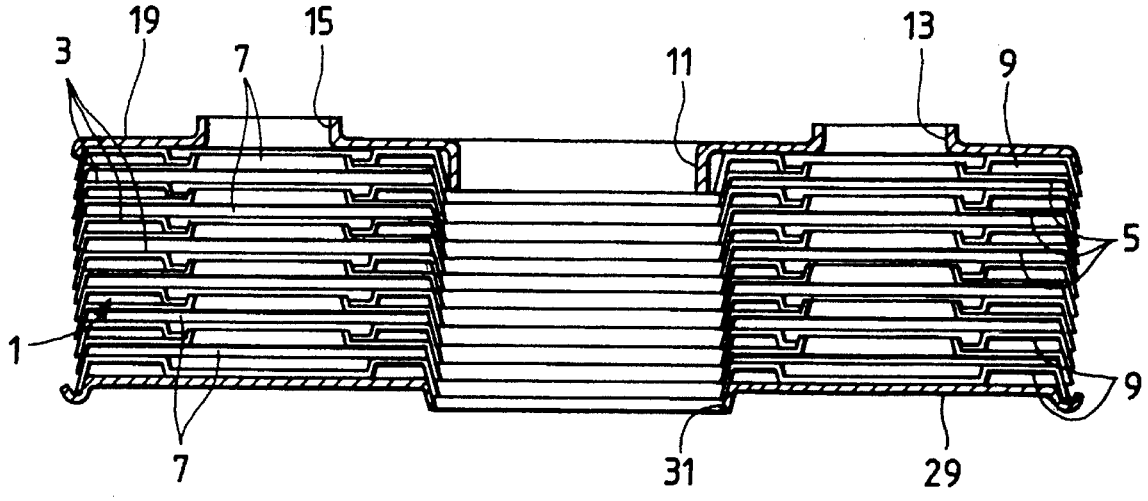
PRIOR ART FIG. 9
FIG. 9 is a sectional view of a core portion of the oil cooler shown in FIG. 8.
Figure 10:
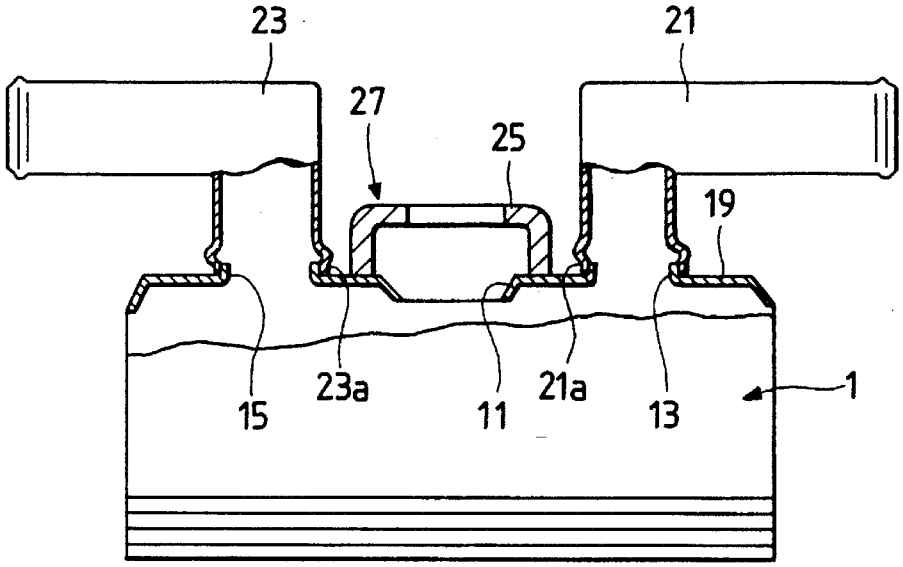
FIG. 10 PRIOR ART
FIG. 10 is a sectional view of a main portion of the oil cooler shown in FIG. 8.

Therefore, according to this embodiment, the reinforcing plate 93 can prevent the oil tank 57 from being deformed by the stress derived from tightening the stud bolt 89, and not only the pressure resistance of the oil tank 57 can be improved, but also the mounting strength of the water pipe 59, 61 is improved compared with the conventional oil collar shown in FIGS. 8–10.

This embodiment is further characterized as increasing the area of radiation of the oil tank 57 for the oil O by arranging the cooling water passage 39 also on the uppermost layer of the core portion 33 that is in contact with the oil tank 57. Therefore, the heat exchange efficiency between the oil O and the cooling water W is satisfactory.

Figure 7:
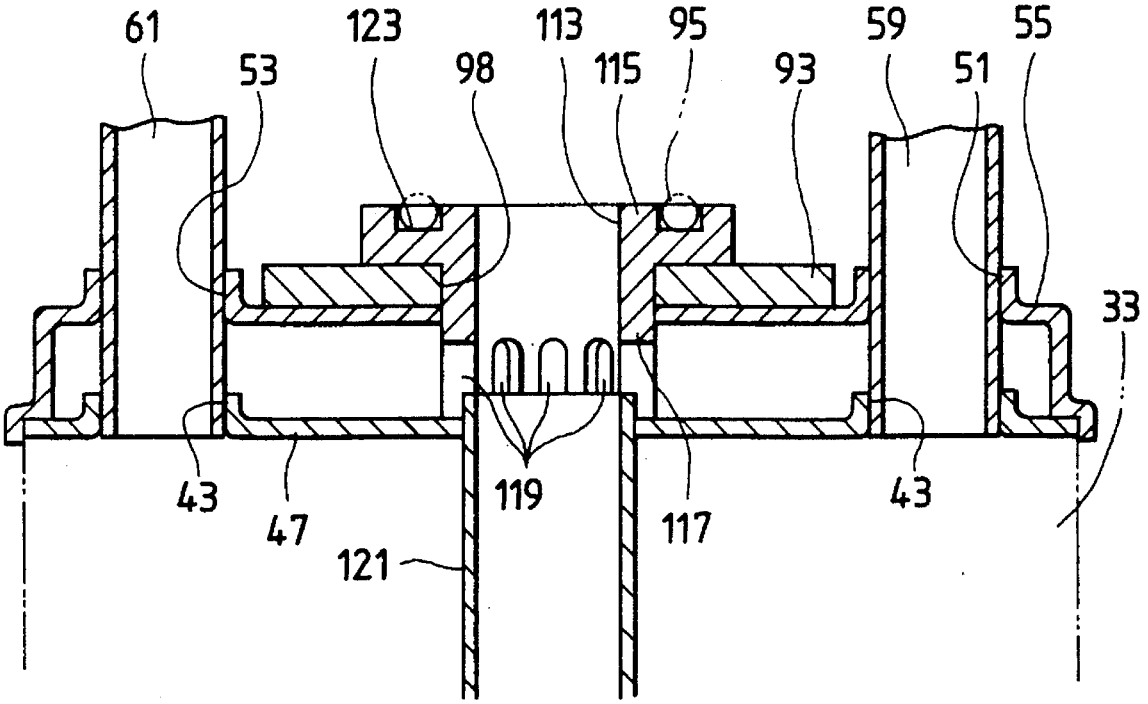
FIG. 7 is a sectional view of a main portion of an oil cooler, which is a second embodiment of the device.

FIG. 7 is a sectional view of a main portion of a second embodiment of the device. This embodiment is characterized as inserting a seat 115 into the through-hole 98 of the reinforcing plate 93 so that a plurality of oil passage holes 119 arranged on a cylindrical portion 117 of the throughhole are opened into the oil tank 57, the seat 115 being T-shaped in section and having a stud bolt insertion hole 113 in the middle thereof. This embodiment is further characterized as inserting a collar 121 from the middle of the core portion 33 to the front end of the cylindrical portion 117. On the upper surface of the seat 115 is a ring groove 123 formed to allow the O-ring 95 to be fitted therein. Since the other structural aspects of the second embodiment are the same as those of the first embodiment, the descriptions thereof will be omitted, and the same parts and components are designated by the same reference numerals.

Thus, the second embodiment can also prevent the oil tank 57 from being deformed by the stresses attributable to tightening the stud bolt 89 with the reinforcing plate 93, and improve not only the pressure resistance of the oil tank 57, but also the mounting strength of the water pipes 59, 61 compared with the conventional oil cooler shown in FIGS. 8–1. Hence, similarly to the first embodiment, the second embodiment can achieve the object of the device.

As described in the foregoing embodiments, according to the present invention, the mounting strength of the water pipes against external stresses can be improved compared with the conventional oil cooler.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

What is claimed is:

1. An oil cooler comprising:

a core portion formed by alternately stacking a plurality of plates (35, 37) and alternately forming cooling water passages (39) and oil passages (41) between the plates, said core portion having an oil return passage extending longitudinally therethrough;

an oil tank (57) formed on an upper portion of the core portion (33), the oil tank (57) being formed between an upper plate (47) and a cover plate (55), the upper plate (47) having cooling water passage holes (43) and an oil passage hole (45), the cover plate (55) having water pipe insertion holes (51, 53) on a top surface of the cover plate (55) so as to correspond to the cooling water passage holes (43), the cooling water passage holes (43) and the oil passage hole (45) communicating with the cooling water passages (39) and the oil passages (41) such that oil flows sequentially through said oil passages (41), said oil passage hole (45), said oil tank (57) and said oil return passage; and two water pipes, (59, 61) passing through the respective pipe insertion holes (51, 53) of the cover plate (55) and through the oil tank (57) to maximize heat transfer from said oil to said water, said water pipes being unperforated between said cover plate (55) and said upper plate (47), said water pipes (59, 61) thus being inserted into the respective cooling water passage holes (43) of the upper plate (47), wherein said upper plate and said cover plate both support said water pipes, each of said water pipes being supported in at least two points.

2. An oil cooler according to claim 1, in which said oil tank (57) is defined by a space between the upper surface of said upper plate (47) and the lower surface of said cover plate (55).

3. An oil cooler according to claim 1, in which said cover plate (55) further comprises upstanding walls for supporting a portion of said water pipes (59, 61), said upstanding walls extending along the periphery of said water pipe insertion holes (51,53), respectively.

4. An oil cooler according to claim 2, in which said cover plate (55) further comprises upstanding walls for supporting a portion of said water pipes (59, 61), said upstanding walls extending along the periphery of said water pipe insertion holes (51,53), respectively.

5. An oil cooler according to claim 1, further comprising a reinforcing plate (93) located between said water pipes (59, 61) for reinforcing said cover plate (55).

* * * * *